US009087635B2

(12) United States Patent
Rosado et al.

(10) Patent No.: US 9,087,635 B2
(45) Date of Patent: Jul. 21, 2015

(54) LOAD TAP CHANGER

(75) Inventors: Sebastian Pedro Rosado, Munich (DE); Tiziana Bertoncelli, Munich (DE); Piniwan Thiwanka Bandara Wijekoon, Munich (DE); Ara Panosyan, Munich (DE); Manoj Ramprasad Shah, Latham, NY (US); Paolo Soldi, Munich (DE)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 13/593,825

(22) Filed: Aug. 24, 2012

(65) Prior Publication Data

US 2014/0055225 A1 Feb. 27, 2014

(51) Int. Cl.

| | |
|---|---|
| ***H01F 21/02*** | (2006.01) |
| ***H01F 21/08*** | (2006.01) |
| ***G05F 1/14*** | (2006.01) |
| ***G05F 1/147*** | (2006.01) |
| ***G05F 1/12*** | (2006.01) |
| ***H01F 29/04*** | (2006.01) |

(52) U.S. Cl.
CPC ..... *H01F 29/04* (2013.01)

(58) Field of Classification Search
USPC ..... 336/150, 145, 155; 323/255, 256, 264
See application file for complete search history.

(56) References Cited

U.S. PATENT DOCUMENTS

| | | | | |
|---|---|---|---|---|
| 3,581,188 | A * | 5/1971 | Watanabe et al. | 323/340 |
| 3,662,253 | A * | 5/1972 | Yamamoto | 323/343 |
| 5,408,171 | A | 4/1995 | Eitzmann et al. | |
| 5,604,424 | A | 2/1997 | Shuttleworth | |
| 6,472,851 | B2 | 10/2002 | Hammond | |
| 6,856,122 | B2 | 2/2005 | Dohnal et al. | |
| 7,099,169 | B2 * | 8/2006 | West et al. | 363/132 |
| 7,333,349 | B2 * | 2/2008 | Chang et al. | 363/17 |

(Continued)

FOREIGN PATENT DOCUMENTS

| | | |
|---|---|---|
| CN | 101958195 | 1/2011 |
| WO | 2011033254 | 3/2011 |

OTHER PUBLICATIONS

N.F. Mailah et al., "Microcontroller Based Semiconductor Tap Changer for Power Transformer," IEEE Bologna Power Tech Conference3, Jun. 23-26, 2003, 6 pages.

(Continued)

*Primary Examiner* — Elvin G Enad
*Assistant Examiner* — Kazi Hossain
(74) *Attorney, Agent, or Firm* — Nitin N. Joshi

(57) ABSTRACT

A load tap changer includes a mechanical switch, a semiconductor switch and an impedance branch or an uncontrolled semiconductor switch. The mechanical switch is connected to a power terminal of a voltage conversion device to carry an electric current and is activated to switch from a first tap to a second tap of the voltage conversion device when a tap change signal is received. The semiconductor switch is then connected between the first tap and the power terminal of the voltage conversion device and is disconnected before the mechanical switch is connected to the second tap. The impedance branch or the uncontrolled semiconductor switch is connected between the second tap and the power terminal of the voltage conversion device before the mechanical switch is connected to the second tap. The impedance or the uncontrolled semiconductor switch is disconnected after the mechanical switch is connected to the second tap.

20 Claims, 5 Drawing Sheets

(56) References Cited

U.S. PATENT DOCUMENTS

| | | | | |
|---|---|---|---|---|
| 7,355,369 | B2 | 4/2008 | Lavieville et al. | |
| 7,436,155 | B2 * | 10/2008 | Renken | 323/207 |
| 7,595,614 | B2 | 9/2009 | Stich et al. | |
| 8,519,682 | B2 * | 8/2013 | Oates et al. | 323/258 |
| 8,576,038 | B2 * | 11/2013 | Kraemer et al. | 336/150 |
| 2004/0032699 | A1 | 2/2004 | Dohnal et al. | |
| 2009/0146637 | A1 * | 6/2009 | Stich et al. | 323/343 |
| 2009/0230933 | A1 | 9/2009 | Oates et al. | |
| 2011/0005910 | A1 | 1/2011 | Fujita et al. | |
| 2011/0102056 | A1 | 5/2011 | Brueckl et al. | |
| 2012/0032654 | A1 | 2/2012 | Brueckl et al. | |
| 2012/0306471 | A1 | 12/2012 | Green et al. | |

OTHER PUBLICATIONS

G.H. Cooke et al., "New thyristor assisted diverter switch for on load transformer tap changers," IEE Proceedings-B, vol. 139, No. 6, Nov. 1992, pp. 507-511.

D. J. Rogers et al., "A Hybrid Diverter Design for Distribution Level On-load Tap Changers," IEEE 978-1-4244-5287-3. 2010. pp. 1493-1500.

J. Arrillaga et al., "A Static Alternative to the Transformer On-Load Tap-Changer," IEEE Transactions on Power Apparatus and Systems, vol. PAS-99, No. 1, Jan./Feb. 1980, pp. 86-91.

D. Dohnal, "On-Load Tap-Changers for Power Transformers a Technical Digest, MR Publication," Jun. 26, 2006, pp. 1-28.

* cited by examiner

LOAD TAP CHANGER

BACKGROUND

Embodiments of the system relate generally to a field of voltage regulation and more specifically to a load tap changer for power delivery.

Electricity is supplied to consumers through a power grid at a very high voltage to reduce energy losses during transmission. The increasing use of distributed and renewable-based generation in the power grid requires more flexibility in network voltage regulation. Transformers have been classically used to scale the network voltage allowing efficient transmission and distribution of power. Nevertheless, their use as a tool for voltage regulation was limited mainly due to the large cost implications, which did not match the otherwise relatively lower cost of power transformers.

For regulating the output voltage of transformers, on-load and off-load tap changers are available in the market. Off-load tap changers are low cost, but require disconnecting the entire load from the transformer prior to each single operation. There are two types of on-load tap changers, mechanical and electronic. Mechanical on-load tap changers allow for in-service operation, but have demanding mechanical requirements making the tap changer large, heavy, and expensive. The maintenance requirements of mechanical components in mechanical on-load tap changers limit the number of tap changes allowed in a lifetime of the tap changer. For this reason, their use is limited to relatively few points in the network, and to a slow voltage variation correction.

The main drawback of mechanical on-load tap changers is unavoidable arcing between two contact terminals when a tap is changed. Electronic on-load tap changers on the other hand do have mechanical contacts but reduce the arcing during tap changing operation by use of semiconductor devices which further reduce maintenance requirements as compared to mechanical on-load tap changers. However, electronic on-load tap changers have higher cost due to the cost of semiconductor switches utilized in the tap changers.

For these and other reasons, there is a need for an improved load tap changer.

BRIEF DESCRIPTION

In accordance with an embodiment of the present invention, a load tap changer is provided. The load tap changer includes a mechanical switch connected to a power terminal of a voltage conversion device to carry an electric current and activated to switch from a first tap to a second tap of the voltage conversion device when a tap change signal is received. The load tap changed further includes a semiconductor switch connected between the first tap and the power terminal of the voltage conversion device when the tap change signal is received and disconnected before the mechanical switch is connected to the second tap. The load tap changer also includes an impedance branch or an uncontrolled semiconductor switch connected between the second tap and the power terminal of the voltage conversion device before the mechanical switch is connected to the second tap and the impedance or the uncontrolled semiconductor switch is disconnected after the mechanical switch is connected to the second tap.

In accordance with an embodiment of the present invention, a method of operating a load tap changer is provided. The method includes activating a mechanical switch connected to a power terminal of a voltage conversion device to shift from a first tap to a second tap of the voltage conversion device when a tap change signal is received and connecting a semiconductor switch between the first tap and the power terminal of the voltage conversion device when the tap change signal is received. The method also includes disconnecting the semiconductor switch before the mechanical switch is connected to the second tap connecting an impedance branch or an uncontrolled semiconductor switch between the second tap and the output terminal of the voltage conversion device before the mechanical switch is connected to the second tap. The method further includes disconnecting the impedance branch or the uncontrolled semiconductor switch after the mechanical switch is connected to the second tap.

In accordance with another embodiment of the present invention, a method of operating a load tap changer is provided. The method includes transferring an electric current flowing in a mechanical switch connected between a first tap and an output terminal of a voltage conversion device to a first branch including a semiconductor switch and diverting the electric current flowing in the first branch to a second branch including an impedance component or an uncontrolled semiconductor switch. The method also includes transferring the electric current flowing in the second branch to the mechanical switch connected between a second tap and the power terminal.

In accordance with yet another embodiment of the present invention, a load tap changer is provided. The load tap changer includes a mechanical switch connected to a power terminal of a voltage conversion device to carry an electric current and activated to switch from a first tap to a second tap of the voltage conversion device when a tap change signal is received. The load tap changer also includes an impedance branch or an uncontrolled semiconductor switch connected between the first tap and the power terminal of the voltage conversion device when the tap change signal is received and disconnected before the mechanical switch is connected to the second tap. The load tap changer further includes a semiconductor switch connected between the second tap and the power terminal of the voltage conversion device before the mechanical switch is connected to the second tap, wherein the semiconductor switch is disconnected after the mechanical switch is connected to the second tap.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

As used herein, the terms "controller" or "module" refers to software, hardware, or firmware, or any combination of these, or any system, process, or functionality that performs or facilitates the processes described herein.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The invention includes embodiments that relate to a load tap changer utilized for a voltage regulation by changing connections from one tap to another of a voltage conversion device. Though the present discussion provides examples in the context of the load tap changer for a transformer, these load tap changers can be applied to any other voltage conversion or regulation device.

Figure 1:
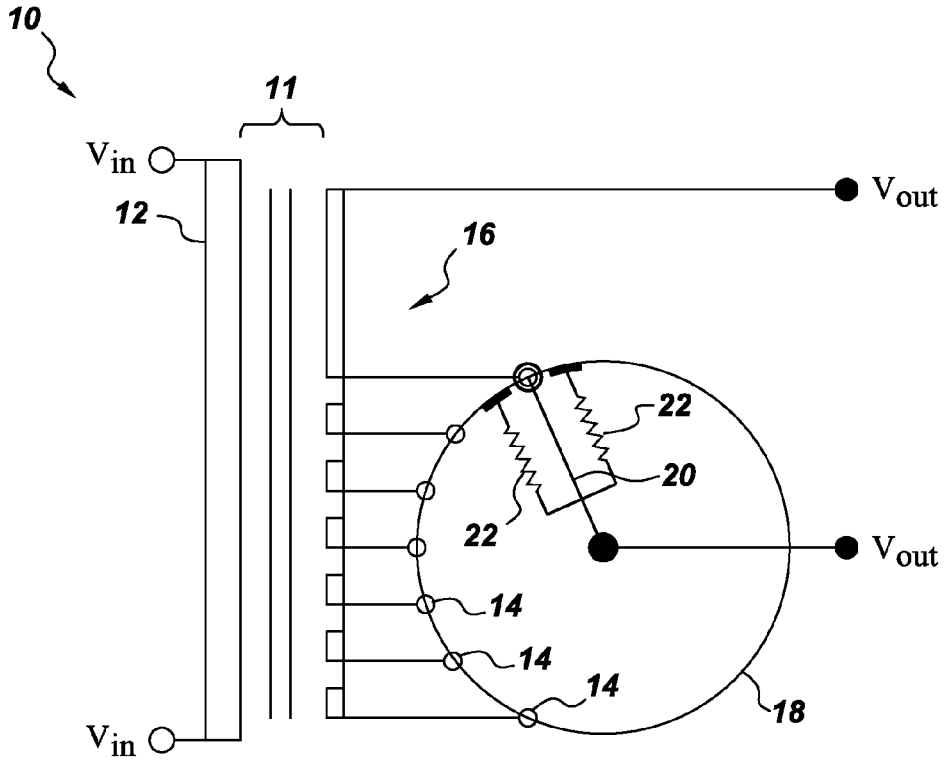
FIG. 1 is a schematic diagram of a transformer with a mechanical on-load tap changer used in a power grid.

FIG. 1 shows a schematic diagram 10 of a transformer 11 with a mechanical on-load tap changer 18 used in a power grid. Transformer 11 is one type of a voltage conversion device which converts a voltage from one level to another level and includes a primary winding 12 and a secondary winding 16 with a plurality of taps 14. In one embodiment, taps 14 may be provided on primary winding 12 or secondary winding 16 or both on primary winding 12 as well as secondary winding 16. In one embodiment, secondary winding 16 provides an output voltage Vo to consumers at a reduced level compared to an input voltage Vin of transformer 11. Because of the variations in loads, a load voltage seen by consumers may vary significantly depending on a transmission distance between a consumer location and transformer 11. The variation in the load voltage may affect various loads. For example, undervoltages may cause motors to run hot and fail, lighting to dim, and batteries to fail to charge properly. Thus, utilities try to compensate for these voltage variations by changing output voltage Vo appropriately.

When a controller (not shown) detects variations in voltages it activates a tap operation. In general, transformer output voltage Vo is given as:

$$Vo = Vin*(T2/T1) \quad (1)$$

where T2 are secondary winding turns and T1 are primary winding turns. The taps 14 on secondary winding 16 decides the number of turns T2. Thus, if output voltage Vo needs to be increased, taps 14 are changed such that winding turns T2 will increase. Similarly, when output voltage Vo needs to be decreased, taps 14 are changed appropriately to decrease turns T2.

Mechanical on-load tap changer 18 which includes a mechanical switch 20 and switching resistors 22 is utilized to change taps 14 from one position to another position. For changing the taps from one position to another, mechanical on-load tap changer 18 utilizes a drive system (not shown) and rotates mechanical switch 20 and switching resistors 22 anticlockwise or clockwise depending on the voltage change requirement. During the movement, at first one of the switching resistors 22 makes contact with the next tap while mechanical switch 20 is still in contact with the present tap. Then mechanical switch 20 is open circuited i.e., mechanical switch 20 is not connected to any tap, whereas the second switching resistor 22 makes connection with the present tap. This results in short circuit between two taps 14 through two switching resistors 22. Finally, mechanical switch 20 contacts the next tap and then both switching resistors 22 are open circuited completing the tap change operation. The complete tap change operation results in significant energy losses in switching resistors 22 and also related heat generation and maintenance issues.

Figure 2:
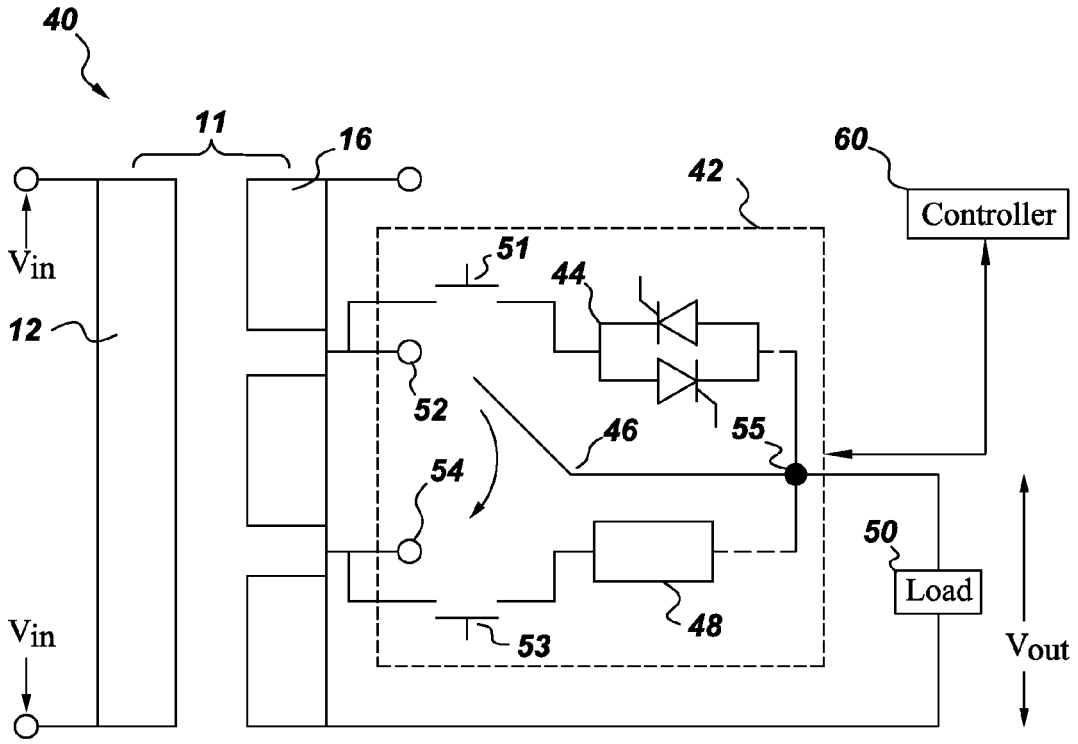
FIG. 2 is a schematic diagram of a transformer with an electronic on-load tap changer in accordance with an embodiment of the present system.

FIG. 2 shows a schematic diagram 40 of transformer 11 with an electronic on-load tap changer 42 in accordance with an embodiment of the present invention. Electronic on-load tap changer 42 includes a semiconductor switch 44 with a first contactor 51 to connect or disconnect semiconductor switch 44 from a tap 52, a mechanical switch 46 connected to a power terminal 55 on one end to carry an electric current, and an impedance component or impedance branch 48 with a second contactor 53 to connect or disconnect impedance branch 48 from a tap 54. In one embodiment, a rotation mechanism as disclosed in FIG. 1 may be utilized in place of contactors 51, 53 to connect mechanical switch 46, impedance branch 48 and semiconductor switch 44 to various taps. A load 50 is shown for representative purposes connected to power terminal 55.

Semiconductor switch 44 may be an unidirectional semiconductor switch which allows current to flow only in one direction or a bidirectional semiconductor switch i.e., a switch which allows passage of current in either direction. Examples of the unidirectional semiconductor switch include a thyristor and a gate turn off thyristor (GTOs), whereas examples of the bidirectional semiconductor switch include a thyristor pair connected in antiparallel configuration and a triode for alternating current (TRIAC). In one embodiment, when semiconductor switch 44 is an unidirectional semiconductor switch, it can be turned ON during a forward bias condition. In another embodiment, the entire tap change operation is performed within a time duration of an alternating current (AC) voltage cycle. As will be appreciated by those skilled in the art the forward bias condition occurs when an anode of the unidirectional semiconductor switch is connected to a positive voltage and a cathode of the unidirectional semiconductor switch is connected to a negative voltage. When semiconductor switch 44 is a bidirectional semiconductor switch, it can be turned ON in any half cycle of the AC voltage.

In one embodiment, electronic on-load tap changer 42 may be movable and its movement from one tap to another is controlled by a motor drive (not shown). Further, a controller 60 is utilized to control the operation of semiconductor switch 44, mechanical switch 46 and impedance branch 48. Furthermore, impedance branch 48 may include a resistor, an inductor, a capacitor or any combination thereof. The use of inductor in the impedance branch 48 reduces a current magnitude and also losses in the resistor. The design parameters of impedance branch 48 include a peak current and current ripple in impedance branch 48, voltage across impedance branch 48, and a time that is required to connect and disconnect the impedance branch.

Figure 3:
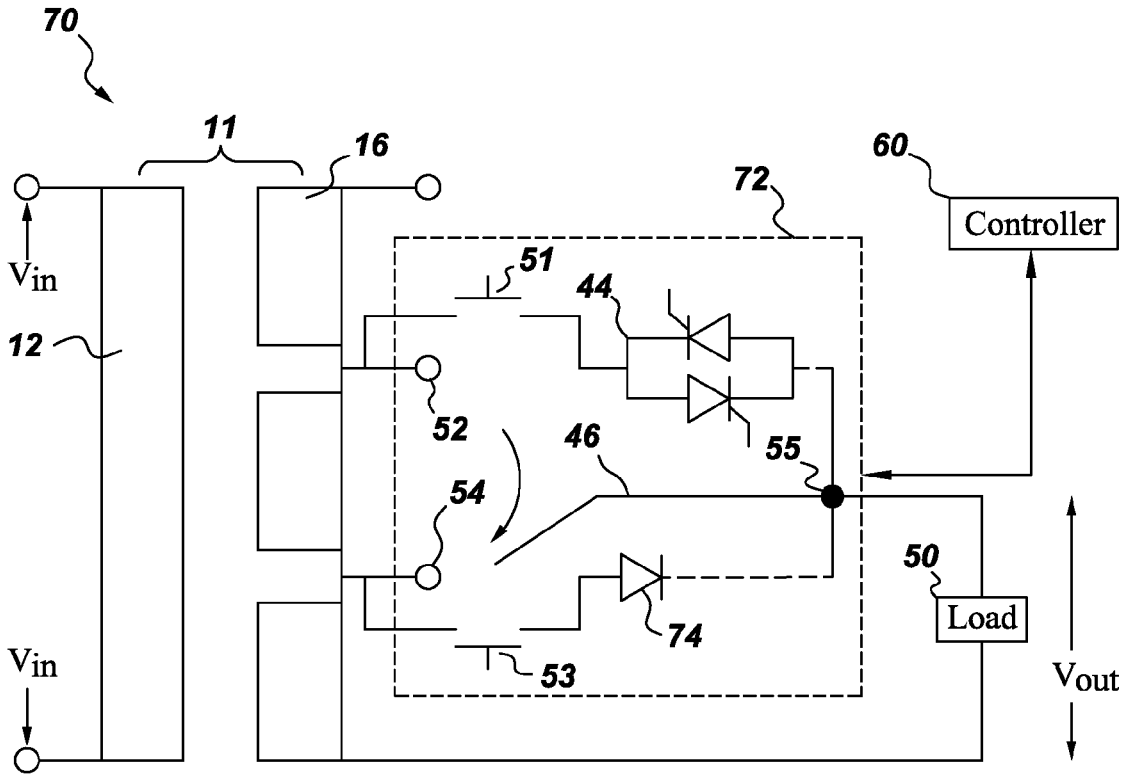
FIG. 3 is a schematic diagram of a transformer with another electronic on-load tap changer in accordance with an embodiment of the present invention.
Figure 4A:
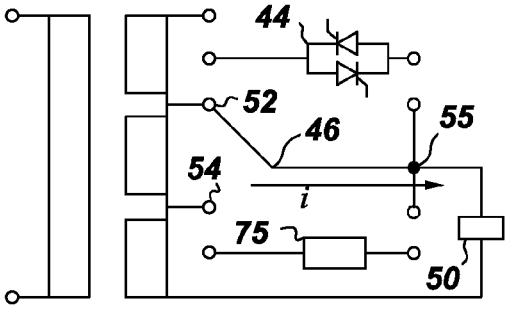
FIG. 4 is a schematic diagram of various steps in an operation of the electronic on-load tap changers of FIGS. 2 and 3 in accordance with an embodiment of the present invention.
Figure 4B:
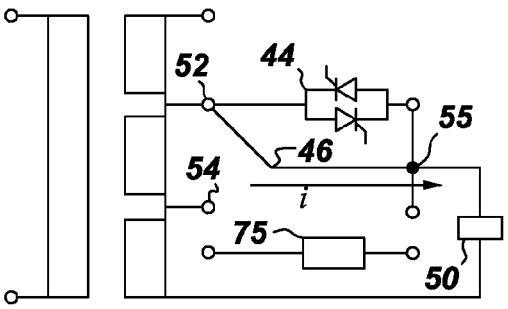
Figure 4C:
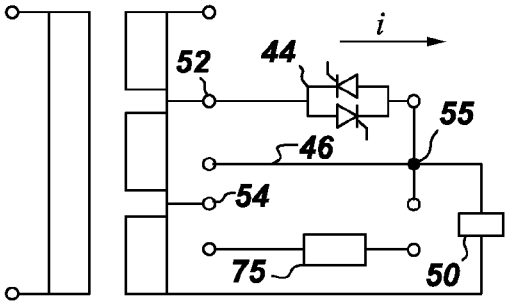
Figure 4D:
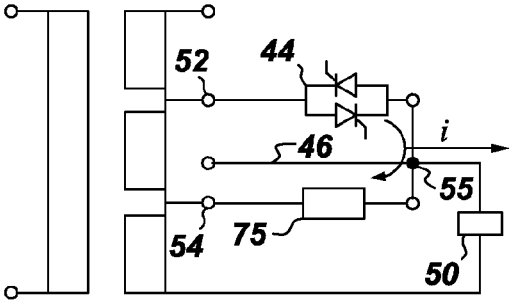
Figure 4E:
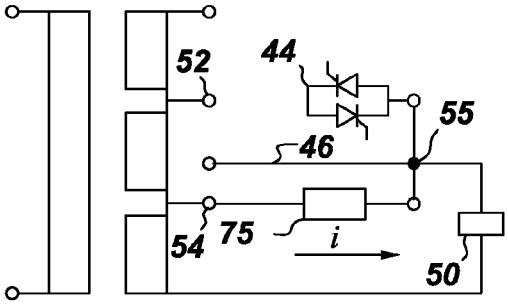
Figure 4F:
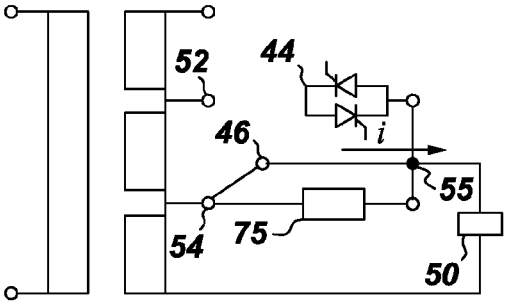
Figure 4G:
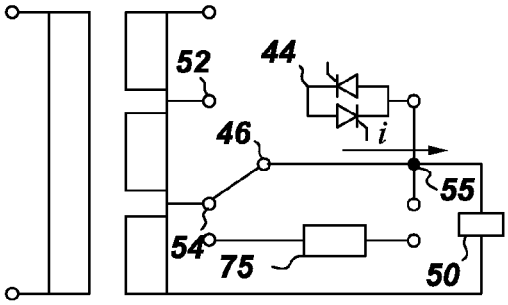

FIG. 3 shows a schematic diagram 70 of transformer 11 with another electronic on-load tap changer 72 in accordance with an embodiment of the present invention. In contrast to FIG. 2, electronic on-load tap changer 72 of FIG. 3 utilizes an uncontrolled semiconductor switch 74 instead of impedance branch 48. As will be appreciated by those skilled in the art, the uncontrolled semiconductor switch does not need any gating signal to turn it ON or turn it OFF. Rather, the uncontrolled semiconductor switch turns on and turns OFF based on voltage across its two terminals. In one embodiment, uncontrolled semiconductor switch 74 may be a diode.

FIG. 4 shows a schematic diagram of various steps in an operation of electronic on-load tap changers 42 and 72 of FIGS. 2 and 3 respectively in accordance with an embodiment of the present invention. Assume that load 50 connected to power terminal 55 is to be moved from tap 52 to tap 54. In step 1 (FIG. 4*a*), a tap change command is set by either a system operator or a feedback controller based on the load voltage. It should be noted that load 50 is illustrated for representative purposes only. In other embodiments, secondary winding 16 may be of a three phase transformer which is connected to the power grid and the load is then a plurality of energy consumption devices. In this step, both semiconductor switch 44 and a bypass branch 75 comprising either impedance component 48 (from FIG. 2) or uncontrolled semiconductor switch 74 (from FIG. 3) are open circuited i.e., they do not carry any current and a load current i flows through mechanical switch 46.

In step 2 (FIG. 4*b*), semiconductor switch 44 is first connected to tap 52 through contactor 51 and then gated ON (i.e., a gate control signal is sent to semiconductor switch 44 such that it will start conducting) and thus, semiconductor switch 44 is connected to tap 52. In one embodiment, contactor 51 may be eliminated and connection and disconnection of semiconductor switch 44 is merely controlled through the gate control signal. In step 3 (FIG. 4*c*), the mechanical switch 46 is disconnected from tap 52 and in step 4 (FIG. 4*d*), bypass branch 75 is connected to tap 54. In step 4, as can be seen from FIG. 4*d*, mechanical switch 46 is open circuited. In case branch 75 is an impedance component, a current i flows from bypass branch 75 as well as through semiconductor switch 44. Semiconductor switch 44 is gated OFF (i.e., the control signal sent to semiconductor switch 44 to turn it ON is stopped) in step 5 (FIG. 4*e*) and mechanical switch 46 (FIG. 4*f*) is connected to tap 54 in step 6. Finally at step 7 (FIG. 4*g*), bypass branch 75 is disconnected from tap 54 for completing the tap change operation.

In one embodiment, the connection and disconnection instance of mechanical switch 46 is based on a zero crossing of a voltage waveform or a current (near zero crossing) waveform passing through impedance branch 48 so as to reduce the voltage on mechanical switch 46 at the time of its connection to any tap. In one embodiment, mechanical switch 46 is connected or disconnected near the zero crossing of the voltage waveform or the current waveform.

In another embodiment, at step 5 when bypass branch 75 includes uncontrolled semiconductor switch 74, semiconductor switch 44 is gated OFF shortly after the uncontrolled semiconductor switch 74 is connected. The connection of uncontrolled semiconductor 74 occurs when it is reverse biased. Therefore, at the next current zero crossing the load current transfers from the semiconductor switch 44, which is now gated OFF, to the uncontrolled semiconductor switch 74, which is now forward biased. In this way the current transfer between the branches is smooth and with minimal overlapping. In general, controller 60 utilizes a mechanism to detect when any of the components (semiconductor switch 44, uncontrolled semiconductor switch 74 and mechanical switch 46) are in a correct mode for commuting the current and send gate signals accordingly. In one embodiment, this mechanism can be based on pre-determined times. In another embodiment, the connection and disconnection of bypass branch 75 and semiconductor switch 44 may be reversed as explained in following paragraphs.

FIG. 5 shows a schematic diagram of various steps in an alternative operation of electronic on-load tap changers 42 and 72 of FIGS. 2 and 3, respectively, in accordance with an embodiment of the present invention. This alternative operation steps show load 50 connected to power terminal 55 being transitioned from tap 52 to tap 54. In step 1 (FIG. 5*a*), a tap change command is set by either a system operator or a feedback controller based on the load voltage. In this step, both semiconductor switch 44 and bypass branch 75 are open circuited and mechanical switch 46 is connected to tap 52. The Figure shows an embodiment where bypass branch 75 is a diode, but it can alternatively be an impedance component.

Figure 5A:
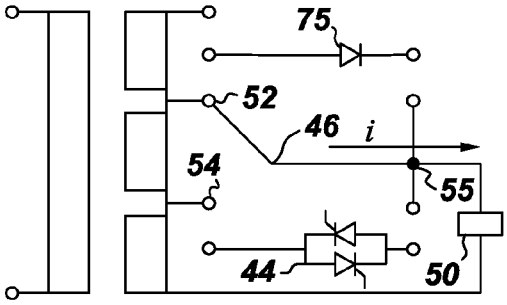
FIG. 5 is a schematic diagram of various steps in an alternative operation of the electronic on-load tap changers of FIGS. 2 and 3 in accordance with an embodiment of the present invention.
Figure 5B:
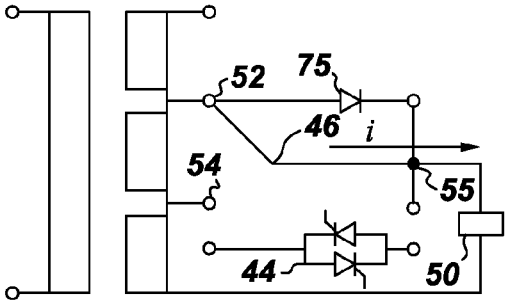
Figure 5C:
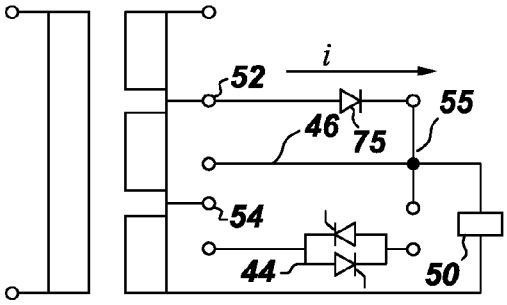
Figure 5D:
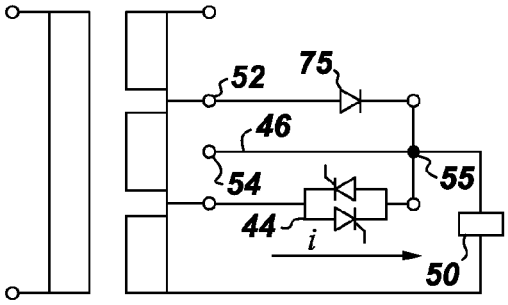
Figure 5E:
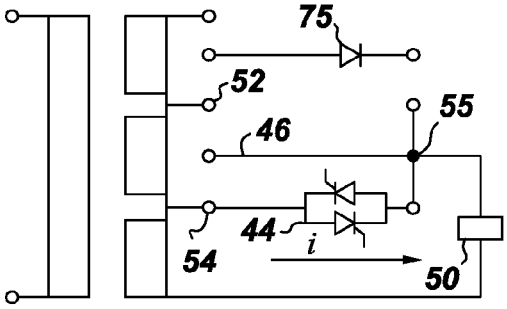
Figure 5F:
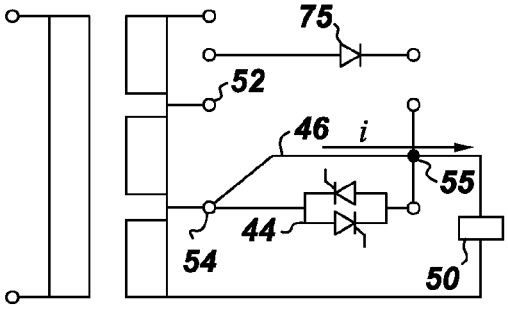
Figure 5G:
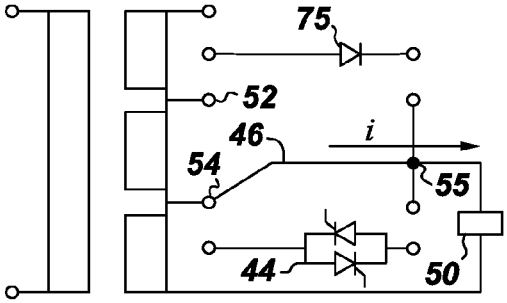

In step 2 (FIG. 5*b*), bypass branch 75 is first connected to tap 52 and then mechanical switch 46 is disconnected from tap 52 in step 3 (FIG. 5*c*). In one embodiment, where bypass branch 75 includes uncontrolled semiconductor switch 74, mechanical switch 46 is disconnected from tap 52 when uncontrolled semiconductor switch 74 is forward biased. Thus, providing a current path through uncontrolled semiconductor switch 74. In step 4 (FIG. 5*d*), semiconductor switch 44 is connected to tap 54 and gated ON. Further, in step 5 (FIG. 5*e*), bypass branch 75 is disconnected from tap 52 when current in bypass branch 75 is around zero, or the diode is reverse biased. In step 6 (FIG. 5*f*), mechanical switch is connected to tap 54 and in step 7 (FIG. 5*g*) semiconductor switch 44 is gated OFF and then disconnected.

Figure 6:
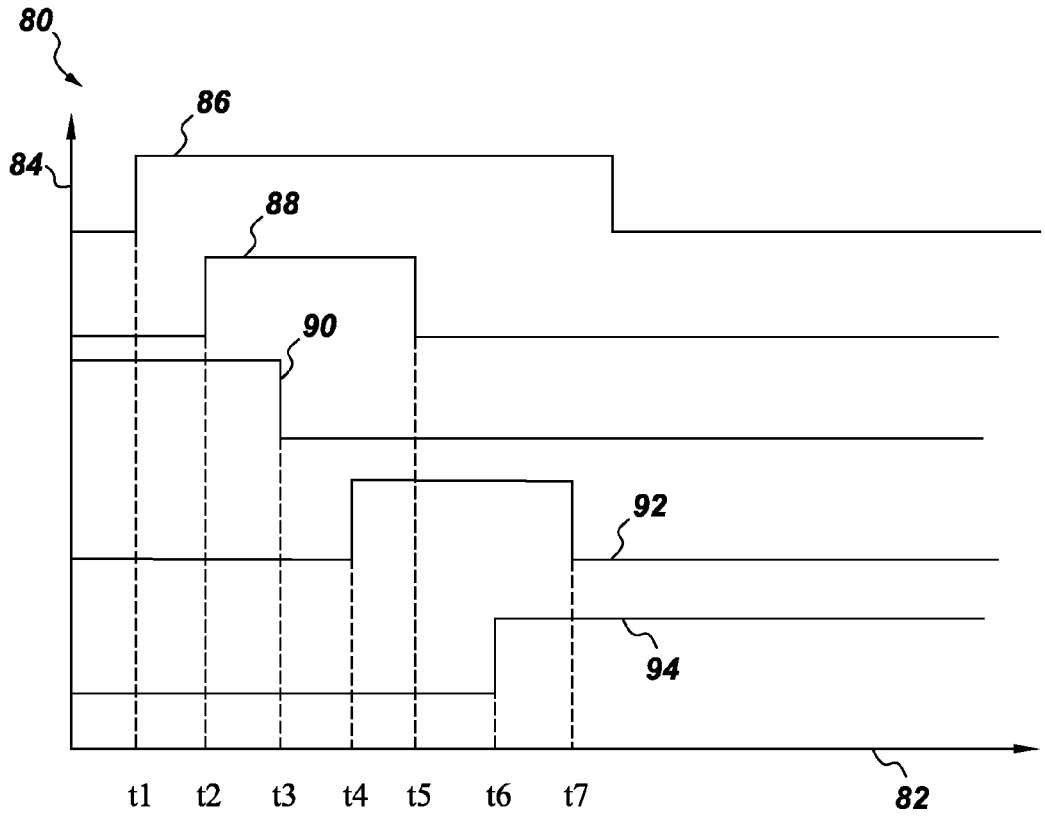
FIG. 6 is a graphical plot of various control signals of the electronic on-load tap changer of FIG. 3.

FIG. 6 shows a graphical plot 80 of various control signals of electronic on-load tap changer 72 of FIG. 3. In plot 80, a horizontal axis 82 represents time and a vertical axis 84 shows whether the given signal is high or low. As can be seen from plot 80, a tap change signal 86 is activated at time t1 by either an operator or controller 60. It should be noted that tap change signal 86 is merely a flag and can be lowered anytime thereafter once further tap changes are not needed. Once the tap change signal 86 is activated, at time t2 a first gate control signal 88 for semiconductor switch 44 is sent by controller 60 resulting in semiconductor switch 44 getting connected and gated ON shortly thereafter. At time t3, a first tap signal 90 for tap 52 is made low thus causing mechanical switch 46 to disconnect from tap 52. Once mechanical switch 46 is disconnected from tap 52, a second contactor control signal 92 is sent to uncontrolled semiconductor switch 74 at time t4 to make a connection. This connection occurs when uncontrolled semiconductor switch 74 is reverse biased. As soon as uncontrolled semiconductor switch 74 is connected the semiconductor switch 44 can be gated OFF by lowering first gate control signal 88 at time t5, which in one embodiment occurs before the uncontrolled switch 74 getting forward biased. Between t5 and t6 the load current changes direction and transitions from semiconductor switch 44 to uncontrolled semiconductor switch 74 At time t6, a second tap signal 94 for tap 52 is made high connecting mechanical switch 46 to tap 52 and finally at time t7, second contactor control signal is made low to disconnect uncontrolled semiconductor switch 74 completing the tap change operation. It should be noted that tap numbers mentioned above are only some examples and in general any tap position can be transitioned from one tap to another tap.

Figure 7:
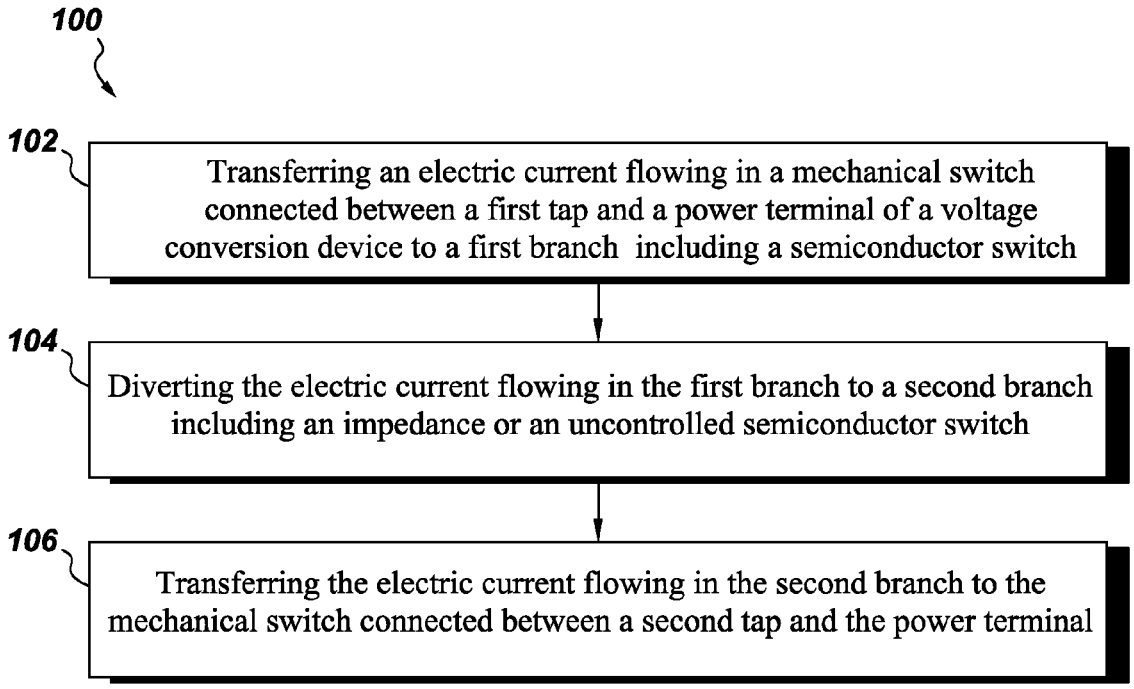
FIG. 7 is a flowchart illustrating a method of operating an on-load tap changer of a transformer having a plurality of taps in accordance with an embodiment of the present invention.

FIG. 7 shows a flowchart illustrating a method of operating an on-load tap changer in accordance with an embodiment of the present invention. At step 102, the method includes transferring an electric current flowing in a mechanical switch connected between a first tap and a power terminal of a voltage conversion device to a first branch, where the first branch includes a semiconductor switch. As mentioned earlier, transferring the electric current includes first connecting and then gating ON the semiconductor switch between the first tap and the power terminal and then disconnecting the mechanical switch from the first tap.

At step 104, the electric current flowing in the first branch is diverted to a second branch which includes either an impedance component or an uncontrolled semiconductor switch. The process of diverting the electric current to the second branch includes first connecting the second branch to the second tap and then gating OFF or disconnecting the semiconductor switch from the first tap. Finally at step 106, the electric current is transferred back to the mechanical switch which is now connected between the second tap and the power terminal. In this step, first the mechanical switch is connected to the second tap and then the second branch is disconnected from the second tap.

One of the advantages of the proposed on-load tap changer is significant maintenance reduction. Further the on-load tap changer has higher efficiency because of lower losses in the impedance branch and semiconductor devices and the components utilized are minimal resulting in lower cost.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A load tap changer comprising:

a mechanical switch connected to a power terminal of a voltage conversion device to carry an electric current and activated to switch from a first tap to a second tap of the voltage conversion device when a tap change signal is received;

a semiconductor switch connected between the first tap and the power terminal of the voltage conversion device when the tap change signal is received and disconnected before the mechanical switch is connected to the second tap; and an impedance branch or an uncontrolled semiconductor switch connected between the second tap and the power terminal of the voltage conversion device before the mechanical switch is connected to the second tap, wherein the impedance or the uncontrolled semiconductor switch is disconnected after the mechanical switch is connected to the second tap.

2. The load tap changer of claim 1, wherein the semiconductor switch comprises a bidirectional switch.

3. The load tap changer of claim 2, wherein the bidirectional switch comprises a thyristor pair connected in antiparallel configuration or a triode for alternating current (TRIAC) or a combination of unidirectional switches.

4. The load tap changer of claim 1, wherein the first tap and the second tap are any two taps of the voltage conversion device.

5. The load tap changer of claim 1, wherein the impedance branch includes a resistor, an inductor, a capacitor or a combination thereof.

6. The load tap changer of claim 1, wherein design parameters of the impedance branch comprise a peak current and a current ripple in the impedance branch, a voltage across the impedance branch and a time required to connect and disconnect the impedance branch to the second tap.

7. The load tap changer of claim 1, wherein a connection and disconnection instance of the mechanical switch is based on a zero crossing of a voltage waveform across the impedance branch or a zero crossing of a current waveform through the impedance branch.

8. The load tap changer of claim 1, wherein the uncontrolled semiconductor switch comprises a diode.

9. The load tap changer of claim 1, wherein the semiconductor switch is not triggered when the uncontrolled semiconductor switch is forward biased.

10. The load tap changer of claim 1, wherein the uncontrolled semiconductor switch is connected during a reverse bias condition.

11. A method of operating a load tap changer comprising:

activating a mechanical switch connected to a power terminal of a voltage conversion device to shift from a first tap to a second tap of the voltage conversion device when a tap change signal is received;

connecting a semiconductor switch between the first tap and the power terminal of the voltage conversion device when the tap change signal is received and disconnecting before the mechanical switch is connected to the second tap;

connecting an impedance branch or an uncontrolled semiconductor switch between the second tap and the output terminal of the voltage conversion device before the mechanical switch is connected to the second tap; and disconnecting the impedance branch or the uncontrolled semiconductor switch after the mechanical switch is connected to the second tap.

12. The method of claim 11, wherein connecting the semiconductor switch between the first tap and the power terminal includes connecting the semiconductor switch during a forward bias condition.

13. The method of claim 11, wherein the impedance branch comprises a resistor, an inductor, a capacitor or a combination thereof.

14. The method of claim 11, wherein the uncontrolled semiconductor switch comprises a diode or.

15. A method of operating a load tap changer comprising:

transferring an electric current flowing in a mechanical switch connected between a first tap and an output terminal of a voltage conversion device to a first branch including a semiconductor switch;

diverting the electric current flowing in the first branch to a second branch including an impedance component or an uncontrolled semiconductor switch; and transferring the electric current flowing in the second branch to the mechanical switch connected between a second tap and the power terminal.

16. The method of claim 15, wherein transferring the electric current flowing in the mechanical switch comprises first connecting the first branch between the first tap and the power terminal and then disconnecting the mechanical switch from the first tap.

17. The method of claim 15, wherein diverting the electric current flowing in the first branch comprises first connecting the second branch to the second tap and then disconnecting the first branch from the first tap.

18. The method of claim 15, wherein transferring the electric current flowing in the second branch comprises first connecting the mechanical switch to the second tap and then disconnecting the second branch from the second tap.

19. A load tap changer comprising:

a mechanical switch connected to a power terminal of a voltage conversion device to carry an electric current and activated to switch from a first tap to a second tap of the voltage conversion device when a tap change signal is received;

an impedance branch or an uncontrolled semiconductor switch connected between the first tap and the power terminal of the voltage conversion device when the tap change signal is received and disconnected before the mechanical switch is connected to the second tap; and a semiconductor switch connected between the second tap and the power terminal of the voltage conversion device before the mechanical switch is connected to the second tap, wherein the semiconductor switch is disconnected after the mechanical switch is connected to the second tap.

20. The load tap changer of claim 19, wherein the first tap and the second tap are any two taps of the voltage conversion device.

* * * * *